United States Patent [19]

Dohnomoto

[11] Patent Number: 4,601,956

[45] Date of Patent: Jul. 22, 1986

[54] COMPOSITE MATERIAL MADE FROM MATRIX METAL REINFORCED WITH MIXED AMORPHOUS ALUMINA-SILICA FIBERS AND MINERAL FIBERS

[75] Inventor: Tadashi Dohnomoto, Toyota, Japan

[73] Assignee: Toyota Jidosha Kabushiki Kaisha, Toyota, Japan

[21] Appl. No.: 734,655

[22] Filed: May 16, 1985

[30] Foreign Application Priority Data

Mar. 1, 1985 [JP] Japan ..... 60-040906

[51] Int. Cl.[4] ..... B32B 5/02; B32B 7/00

[52] U.S. Cl. ..... 428/614; 428/608; 428/610

[58] Field of Search ..... 428/614, 610, 608

[56] References Cited

U.S. PATENT DOCUMENTS

| | | | |
|---|---|---|---|
| 4,157,409 | 6/1979 | Levitt et al. | 428/608 |
| 4,223,075 | 9/1980 | Harrigan et al. | 428/614 |
| 4,457,979 | 7/1984 | Donomoto et al. | 428/614 |

FOREIGN PATENT DOCUMENTS

| | | | |
|---|---|---|---|
| 56-23242 | 3/1981 | Japan | 428/614 |

*Primary Examiner*—Veronica O'Keefe

*Attorney, Agent, or Firm*—Oblon, Fisher, Spivak, McClelland & Maier

[57] ABSTRACT

This composite material includes reinforcing hybrid fiber mixture material in a matrix of metal which is aluminum, magnesium, copper, zinc, lead, tin, or an alloy having these as principal components. The hybrid fiber mixture is a mixture of amorphous alumina-silica fiber material and mineral fiber material. The amorphous alumina-silica fiber material has as principal components 35% to 80% by weight of $Al_2O_3$ and 65% to 20% by weight of $SiO_2$, with a content of other substances of less than or equal to 10% by weight, with the percentage of non fibrous particles included therein being less than or equal to about 17% by weight, and with the percentage of non fibrous particles with diameters greater than 150 microns being less than or equal to 7% by weight. And the mineral fiber material has as principal components $SiO_2$, CaO, and $Al_2O_3$, the content of MgO being less than or equal to 10% by weight, the content of $Fe_2O_3$ being less than or equal to 5% by weight, and the content of other inorganic substances being less than or equal to 10% by weight, with the percentage of non fibrous particles being less than or equal to 20% by weight, and with the percentage of non fibrous particles with diameters greater than 150 microns being less than or equal to 7% by weight. The volume proportion of the reinforcing hybrid fiber material is at least 1%. The qualities of this composite material with regard to wear and bending strength are good.

16 Claims, 10 Drawing Figures

COMPOSITE MATERIAL MADE FROM MATRIX METAL REINFORCED WITH MIXED AMORPHOUS ALUMINA-SILICA FIBERS AND MINERAL FIBERS

BACKGROUND OF THE INVENTION

The present invention relates to a type of composite material which includes fiber material as reinforcing material embedded in a mass of matrix metal, and more particularly relates to such a type of composite material in which the reinforcing material is a mixture of amorphous alumina-silica fiber material and mineral fiber material and the matrix metal is aluminum, magnesium, copper, zinc, lead, tin, or an alloy having one or more of these as principal component or components.

In the prior art, relatively low melting point metals such as aluminum, magnesium, copper, zinc, lead, tin, or alloys having one or more of these as principal component or components have been very popular for use as materials for members which are in sliding contact with mating members, because of their affinity for such mating members and their good frictional characteristics. However nowadays, along with increasing demands for higher mechanical performance, the conditions in which such materials are required to operate are becoming more and more harsh, and tribological problems such as excessive frictional wear and adhesion burning occur more and more often; in the extreme case, these problems can lead to seizure of a moving member. For instance, if a diesel engine with aluminum alloy pistons is run under extreme conditions, there may arise problems with regard to abnormal wear to the piston ring grooves on the piston, or with regard to burning of the piston and of the piston rings.

One effective means that has been adopted for overcoming these tribological problems has been to reinforce such a relatively low melting point metal or alloy by an admixture of reinforcing fibers made of some extremely tough and hard material. Thus, various composite materials including fibrous materials of various kinds as reinforcing material have been proposed. The advantages of such fiber reinforced materials include improved lightness, improved strength, enhanced wear characteristics, improved resistance to heat and burning, and so on. In particular, such concepts are disclosed in Japanese Patent Laying Open Publications Ser. Nos. Sho 58-93948 (1983), Sho 58-93837 (1983), Sho 58-93841 (1983), and Sho 59-70736 (1984), of all which Japanese patent applications the applicant was the same entity as the assignee of the present patent application, and none of which is it intended hereby to admit as prior art to the present application except insofar as otherwise obliged by law. Further, for the fiber reinforcing material, there have been proposed the following kinds of inorganic fiber materials: alumina fiber material, alumina-silica fiber material, silicon carbide fiber material, silicon nitride fiber material, carbon fiber material, potassium titanate fiber material, and mineral fiber material; and for the matrix metal, aluminum alloy and various other alloys have been suggested. Such prior art composite materials are disclosed, for example, in the above cited Japanese Patent Laying Open Publications Ser. Nos. Sho 58-93837 (1983) and Sho 58-93841 (1983). Of these abovementioned reinforcing fiber materials, for superior wear resistance properties and relatively low cost, the alumina-silica type, that is to say, either alumina fibers or alumina-silica fibers, are preferred—see Japanese Patent Laying Open Publication Ser. No. Sho 58-93837 (1983) and the abovementioned Japanese Patent Laying Open Publication Ser. No. Sho 58-93841 (1983)—and, for extremely low cost, mineral fibers (see Japanese Patent Application Ser. No. Sho 59-219091 (1984)) are preferred. Again, in the case of these various Japanese patent applications, the applicant was the same entity as the assignee of the present patent application, and it is not intended hereby to admit any of them as prior art to the present application except insofar as otherwise obliged by law.

However, in the case of using alumina fibers as the reinforcing material for a composite material, the problem arises that these alumina fibers are very expensive, and hence high cost for the resulting composite material is inevitable. This cost problem, in fact is one of the biggest current obstacles to the practical application of certain composite materials for making many types of actal components. On the other hand, in contrast to the above mentioned alumina fibers, so called alumina-silica fibers whose principal components are alumina and silica are quite inexpensive, and have conventionally for example been used in quantity as heat insulation fibers, in which case, particularly in view of their handling characteristics, they are normally used in the amorphous amorphous form; therefore, if such alumina-silica fibers could satisfactorily be used as reinforcing fiber material for a composite material, then the cost could be very much reduced.

Further, so called mineral fibers, of which the principal components are $SiO_2$, CaO, and $Al_2O_3$, are very much less costly than the above mentioned other types of inorganic fibers, and therefore if such mineral fibers are used as reinforcing fibers the cost of the resulting composite material can be very much reduced. Moreover, since such mineral fibers have good wettability with respect to molten matrix metals of the types detailed above, and deleterious reactions with such molten matrix metals are generally slight, therefore, as contrasted with the case in which the reinforcing fibers are fibers which have poor wettability with respect to the molten matrix metal and undergo a deleterious reaction therewith, it is possible to obtain a composite material with excellent mechanical characteristics such as strength. On the other hand, such mineral fibers are inferior to the above mentioned other types of inorganic fibers with regard to strength and hardness, and therefore, as contrasted to the cases where the other types of inorganic fibers mentioned above are utilized, it is difficult to manufacture a composite material using mineral fibers as reinforcing fibers which has excellent strength and wear resistance properties.

SUMMARY OF THE INVENTION

The inventors of the present invention have considered in depth the above detailed problems with regard to the manufacture of composite materials, and particularly with regard to the use of alumina-silica fiber material or mineral fiber material as reinforcing material for a composite material, and as a result of various experimental researches (the results of some of which will be given later) have discovered that it is effective to use as reinforcing fiber material for the composite material a mixture of amorphous alumina-silica fiber material and mineral fiber material. And, further, the present inventors have discovered that such a composite material utilizing a mixture of reinforcing fibers has much superior wear characteristics to those which are expected from a composite material having only amorphous alumina-silica fibers as reinforcing material, or from a composite material having only mineral fibers as reinforcing material. In other words, the present inventors have discovered that the properties of a such a composite material utilizing such a mixture of reinforcing fibers are not merely the linear combination of the properties of composite materials utilizing each of the components of said mixture on its own, but exhibit some non additive non linear synergistic effect by the combination of the reinforcing amorphous alumina-silica fibers and the reinforcing mineral fibers.

Accordingly, the present invention is based upon knowledge gained as a result of these experimental researches by the present inventors, and its primary object is to provide a composite material including reinforcing fibers embedded in matrix metal, which has the advantages detailed above including good mechanical characteristics, while overcoming the above explained disadvantages.

It is a further object of the present invention to provide such a composite material, which utilizes inexpensive materials.

It is a further object of the present invention to provide such a composite material, which is cheap with regard to manufacturing cost.

It is a further object of the present invention to provide such a composite material, which is light.

It is a further object of the present invention to provide such a composite material, which has good mechanical strength.

It is yet a further object of the present invention to provide such a composite material, which has high bending strength.

It is yet a further object of the present invention to provide such a composite material, which has good machinability.

It is a yet further object of the present invention to provide such a composite material, which has good resistance against heat and burning.

It is a further object of the present invention to provide such a composite material, which has good wear characteristics with regard to wear on a member made of the composite material itself during use.

It is a yet further object of the present invention to provide such a composite material, which does not cause undue wear on a mating member against which a member made of said composite material is frictionally rubbed during use.

It is a yet further object of the present invention to provide such a composite material, which is not liable to cause scratching on such a mating member against which a member made of said composite material is frictionally rubbed during use.

It is a yet further object of the present invention to provide such a composite material, in the manufacture of which the fiber reinforcing material has good wettability with respect to the molten matrix metal.

It is a yet further object of the present invention to provide such a composite material, in the manufacture of which, although as mentioned above the fiber reinforcing material has good wettability with respect to the molten matrix metal, no deleterious reaction therebetween substantially occurs.

According to the present invention, these and other objects are accomplished by a composite material, comprising: (a) reinforcing material which is a hybrid fiber mixture material comprising: (a1) a substantial amount of amorphous alumina-silica fiber material with principal components about 35% to about 80% by weight of $Al_2O_3$ and about 65% to about 20% by weight of $SiO_2$, and with a content of other substances of less than or equal to about 10% by weight, with the percentage of non fibrous particles included therein being less than or equal to about 17% by weight, and with the percentage of non fibrous particles with diameters greater than about 150 microns included therein being less than or equal to about 7% by weight; and (a2) a substantial amount of mineral fiber material having as principal components $SiO_2$, CaO, and $Al_2O_3$, the content of included MgO therein being less than or equal to about 10% by weight, the content of included $Fe_2O_3$ therein being less than or equal to about 5% by weight, and the content of other inorganic substances included therein being less than or equal to about 10% by weight, with the percentage of non fibrous particles included therein being less than or equal to about 20% by weight, and with the percentage of non fibrous particles with diameters greater than about 150 microns included therein being less than or equal to about 7% by weight; and (b) a matrix metal selected from the group consisting of aluminum, magnesium, copper, zinc, lead, tin, and alloys having these as principal components; wherein (c) the volume proportion of said hybrid fiber mixture material in said composite material is at least 1%.

According to such a composition according to the present invention, the matrix material is reinforced with a volume proportion of at least 1% of this hybrid fiber mixture material, which consists of amorphous alumina-silica fibers which are hard and stable and are very much cheaper than alumina fibers, mixed with mineral fibers, which are even more cheap than alumina fibers, which have good wettability with respect to these kinds of matrix metal and have little deteriorability with respect to molten such matrix metals as described above. Since, as will be described later with regard to experimental researches carried out by the present inventors, the wear resistance characteristics of the composite material are remarkably improved by the use of such hybrid reinforcing fiber material, a composite material which has excellent mechanical characteristics such as wear resistance and strength, and of exceptionally low cost, is obtained. Also, since the percentage of non fibrous particles included in the amorphous alumina-silica fiber material is less than or equal to about 17% by weight and also the percentage of non fibrous particles with diameters greater than about 150 microns included in said amorphous alumina-silica fiber material is less than or equal to about 7% by weight, and further the percentage of non fibrous particles included in the mineral fiber material is less than or equal to about 20% by weight and also the percentage of non fibrous particles with diameters greater than about 150 microns included in said mineral fiber material is less than or equal to about 7% by weight, a composite material with superior strength and machinability properties is obtained, and further there is no substantial danger of abnormal wear such as scratching being caused to a mating member which is in frictional contact with a member made of this composite material during use, due to such non fibrous particulate matter becoming detached from said member made of this composite material.

Generally, alumina-silica type fibers may be categorized into alumina fibers or alumina-silica fibers on the basis of their composition and their method of manufacture. So called alumina fibers, including at least 70% by weight of $Al_2O_3$ and not more than 30% by weight of $SiO_2$, are formed into fibers from a mixture of a viscous organic solution with an aluminum inorganic salt; they are formed in an oxidizing furnace at high temperature, so that they have superior qualities as reinforcing fibers, but are extremely expensive. On the other hand, so called alumina-silica fibers, which have about 35% to 65% by weight of $Al_2O_3$ and about 65% to 35% by weight of $SiO_2$, can be made relatively cheaply and in large quantity, since the melting point of a mixture of alumina and silica has lower melting point than alumina, so that a mixture of alumina and silica can be melted in for example an electric furnace, and the molten mixture can be formed into fibers by either the blowing method or the spinning method. Particularly, if the included amount of $Al_2O_3$ is 65% by weight or more, and the included amount of $SiO_2$ is 35% by weight or less, the melting point of the mixture of alumina and silica becomes too high, and the viscosity of the molten mixture is low; on the other hand, if the included amount of $Al_2O_3$ is 35% by weight or less, and the included amount of $SiO_2$ is 65% by weight or more, a viscosity suitable for blowing or spinning cannot be obtained, and, for reasons such as these, such low cost methods of manufacture are difficult to apply in these cases.

However, although alumina-silica fibers with an included amount of $Al_2O_3$ of 65% by weight or more are not as inexpensive as alumina-silica fibers with an included amount of $Al_2O_3$ of 65% by weight or less, according to the results of the experimental researches carried out by the present inventors, in the case that a hybrid combination is formed of amorphous alumina-silica fibers with an included amount of $Al_2O_3$ of 65% to 80% by weight and of extremely inexpensive mineral fibers, a reasonably inexpensive composite material can be obtained with excellent mechanical properties such as wear resistance and strength. Accordingly it is specified, according to the present invention, that the $Al_2O_3$ content of the amorphous alumina-silica fiber material included in the hybrid reinforcing fiber material for the composite material of the present invention should be between about 35% to about 80% by weight.

Additionally, in order to adjust the melting point or viscosity of the mixture, or to impart particular characteristics to the fibers, it is possible to add to the mixture of alumina and silica such metal oxides as CaO, MgO, $Na_2O$, $Fe_2O_3$, $Cr_2O_3$, $ZrO_2$, $TiO_2$, PbO, $SnO_2$, ZnO, $MoO_3$, NiO, $K_2O$, $MnO_2$, $B_2O_3$, $V_2O_5$, CuO, $Co_3O_4$, and so forth. According to the results of certain experimental researches carried out by the inventors of the present invention, it has been confirmed that it is preferable to restrict such constituents to not more tha 10% by weight. Therefore, the composition of the amorphous alumina-silica fibers used for the reinforcing fibers in the composite material of the present invention has been determined as being required to be from 35% to 80% by weight $Al_2O_3$, from 65% to 20% by weight $SiO_2$, and from 0% to 10% by weight of other components.

Moreover, in the manufacture of alumina-silica fibers by the blowing method or the like, along with the alumina-silica fibers, a large quantity of non fibrous particles are also inevitably produced, and therefore a collection of alumina-silica fibers will inevitably contain a relatively large amount of particles of non fibrous material. According to the results of experimental research carried out by the inventors of the present invention, these non fibrous particles, and particularly the very large non fibrous particles having a particle diameter greater than or equal to 150 microns, if they remain by a large amount in the composite material produced, impair the mechanical properties of said composite material, and are a source of lowered strength for the composite material, and moreover tend to produce problems such as abnormal wear in and scratching on a mating element which is frictionally cooperating with a member made of said composite material, due to these large and hard particles becoming detached from the composite material. Also, such large and hard non fibrous particles tend to deteriorate the machinability of the composite material. Therefore, in the composite material of the present invention, the amount of non fibrous particles included in the amorphous alumina-silica fiber material incorporated in the hybrid fiber material used as reinforcing material is required to be limited to a maximum of 17% by weight, and preferably further is desired to be limited to not more than 10% by weight, and even more preferably is desired to be limited to not more than 7% by weight; and the amount of non fibrous particles of particle diameter greater than or equal to 150 microns included in said amorphous alumina-silica fiber material incorporated in the hybrid fiber material used as reinforcing material is required to be limited to a maximum of 7% by weight, and preferably further is desired to be limited to not more than 2% by weight, and even more preferably is desired to be limited to not more than 1% by weight.

Mineral fiber is a generic name for artificial fiber material including rock wool (or rock fiber) made by forming molten rock into fibers, slag wool (or slag fiber) made by forming iron slag into fibers, and mineral wool (or mineral fiber) made by forming a molten mixture of rock and slag into fibers. Such mineral fiber generally has a composition of about 35% to about 50% by weight of $SiO_2$, about 20% to about 40% by weight of CaO, about 10% to about 20% by weight of $Al_2O_3$, about 3% to about 7% by weight of MgO, about 1% to about 5% by weight of $Fe_2O_3$, and up to about 10% by weight of other inorganic substances. These mineral fibers are also generally produced by a method such as the spinning method, and therefore in the manufacture of such mineral fibers inevitably a quantity of non fibrous particles are also produced together with the fibers. Again, these non fibrous particles are extremely hard, and tend to be large compared to the average diameter of the fibers. Thus, just as in the case of the non fibrous particles included in the amorphous alumina-silica fiber material, they tend to be a source of damage. Again, according to the results of experimental research carried out by the inventors of the present invention, particularly very large such non fibrous particles having a particle diameter greater than or equal to 150 microns, if left in the composite material produced, impair the mechanical properties of said composite material, and are a source of lowered strength for the composite material, and moreover tend to produce problems such as abnormal wear in and scratching on a mating element which is frictionally cooperating with a member made of said composite material, due to these large and hard particles becoming detached from the composite material. Also, such large and hard non fibrous particles in the mineral fiber material tend to deteriorate the machinability of the composite material. Therefore, in the composite material of the present invention, the total amount of non fibrous particles included in the mineral fiber material incorporated in the hybrid fiber material used as reinforcing material is required to be limited to a maximum of 20% by weight, and preferably further is desired to be limited to not more than 10% by weight; and the amount of such non fibrous particles of particle diameter greater than or equal to 150 microns included in said mineral fiber material incorporated in the hybrid fiber material used as reinforcing material is required to be limited to a maximum of 7% by weight, and preferably further is desired to be limited to not more than 2% by weight.

According to the results of further experimental researches carried out by the inventors of the present invention, a composite material in which reinforcing fibers are a mixture of amorphous alumina-silica fibers and mineral fibers has the above described superior characteristics, and, when the matrix metal is aluminum, magnesium, copper, zinc, lead, tin, or an alloy having these as principal components, even if the volume proportion of the reinforcing hybrid fiber mixture material is around 1%, there is a remarkable increase in the wear resistance of the composite material, and, even if the volume proportion of said hybrid fiber mixture material is increased, there is not an enormous increase in the wear on a mating element which is frictionally cooperating with a member made of said composite material. Therefore, in the composite material of the present invention, the total volume proportion of the reinforcing hybrid fiber mixture material is required to be least 1%, and preferably is desired to be not less than 2%, and even more preferably is desired to be not less than 4%.

According to the results of experimental research carried out by the inventors of the present invention, the effect of improvement of wear resistance of a composite material by using as reinforcing material a hybrid combination of amorphous alumina-silica fibers and mineral fibers is, as will be described below in detail, most noticeable when the ratio of the volume proportion of said amorphous alumina-silica fiber material to the total volume proportion of said hybrid fiber mixture material is between about 5% and about 80%, and particularly when said ratio is between about 10% and about 60%. Accordingly, according to another specialized characteristic of the present invention, it is considered to be preferable, in the composite material of the present invention, that said ratio of the volume proportion of said amorphous alumina-silica fiber material to the total volume proportion of said hybrid fiber mixture material should be between about 5% and about 80%, and it is considered to be even more preferable that said ratio should be between about 10% and about 60%.

And, further according to the results of experimental research carried out by the inventors of the present invention, when the ratio of the volume proportion of said amorphous alumina-silica fiber material to the total volume proportion of said hybrid fiber mixture material is relatively low, and the corresponding volume proportion of the mineral fibers is relatively high—for example, if the ratio of the volume proportion of said amorphous alumina-silica fiber material to the total volume proportion of said hybrid fiber mixture material is from about 5% to about 40%—then, unless the total volume proportion of said hybrid fiber mixture material in the composite material is at least 2% and even more preferably is at least 4%, it is difficult to maintain an adequate wear resistance in the composite material. And further it is found that, if the total volume proportion of said hybrid fiber mixture material becomes greater than about 35%, and particularly if said total volume proportion becomes greater than about 40%, then the strength and the wear resistance of the composite material actually start to decrease. Therefore, according to another specialized characteristic of the present invention, it is considered to be preferable, in the composite material of the present invention, that the ratio of the volume proportion of said amorphous alumina-silica fiber material to the total volume proportion of said hybrid fiber mixture material should be between about 5% and about 40%, and even more preferably should be between about 10% and about 40%; and that the total volume proportion of said hybrid fiber mixture material should be in the range from about 2% to about 40%, and even more preferably should be in the range from about 4% to about 35%.

Yet further, according to the results of experimental research carried out by the inventors of the present invention, whatever be the ratio of the volume proportion of said amorphous alumina-silica fiber material to the total volume proportion of said hybrid fiber mixture material, if the total volume proportion of said mineral fiber material in the composite material exceeds about 20%, and particularly if it exceeds about 25%, then the strength and the wear resistance of the composite material are deteriorated. Accordingly, according to another specialized characteristic of the present invention, it is considered to be preferable, in the composite material of the present invention, regardless of the value of the ratio of the volume proportion of said amorphous alumina-silica fiber material to the total volume proportion of said hybrid fiber mixture material, that the total volume proportion of said mineral fiber material in the composite material should be less than about 25%, and even more preferably that said total volume proportion should be less than about 20%.

With regard to the proper fiber dimensions, in order to obtain a composite material with superior mechanical characteristics such as strength and wear resistance, and moreover with superior friction wear characteristics with respect to wear on a mating element, the amorphous alumina-silica fibers included as reinforcing material in said composite material should, according to the results of the experimental researches carried out by the inventors of the present invention, preferably have in the case of short fibers an average fiber diameter of approximately 1.5 to 5.0 microns and a fiber length of 20 microns to 3 millimeters, and in the case of long fibers an average fiber diameter of approximately 3 to 30 microns. On the other hand, since the mineral which is the material forming the mineral fibers also included as reinforcing material in said composite material has a relatively low viscosity in the molten state, and, since the mineral fibers are relatively fragile when compared with other fibers, these mineral fibers are typically made in the form of short fibers (non continuous fibers) with a fiber diameter of about 1 to 10 microns and with a fiber length of about 10 microns to about 10 cm. Therefore, when the availability of low cost mineral fibers is considered, it is desirable that the mineral fibers used in the composite material of the present invention should have an average fiber diameter of about 2 to 8 microns and an average fiber length of about 20 microns to about 5 cm. Moreover, when the method of manufacture of the composite material is considered, it is desirable that the average fiber length of the mineral fibers used in the composite material of the present invention should be about 100 microns to about 5 cm, and, in the case of the powder metallurgy method, should be preferably about 20 microns to about 2 mm.

BRIEF DESCRIPTION OF THE DRAWINGS

The present invention will now be described in terms of several preferred embodiments thereof, and with reference to the appended drawings. However, it should be understood that the description of the embodiments, and the drawings, are not any of them intended to be limitative of the scope of the present invention, since this scope is intended to be understood as to be defined by the appended claims, in their legitimate and proper interpretation. In the drawings, like reference symbols denote like parts and dimensions and so on in the separate figures thereof; spatial terms are to be understood as referring only tho the orientation on the drawing paper of the relevant figure and not to any actual orientation of an embodiment, unless otherwise qualified; in the description, all percentages are to be understood as being by weight unless otherwise indicated; and:

DESCRIPTION OF THE PREFERRED EMBODIMENTS

The present invention will now be described with reference to the preferred embodiments thereof, and with reference to the appended drawings.

TESTS RELATING TO THE FIRST PREFERRED EMBODIMENT

A quantity of alumina-silica fiber material of the type manufactured by Isolite Babcock Taika K.K. Company, with trade name "Kaowool", having a nominal composition of 39% by weight of $Al_2O_3$ and 60% by weight of $SiO_2$ (remainder impurities), with a quantity of non fibrous material intermingled therewith, was subjected to per se known particle elimination processing such as filtration or the like, so that the total proportion of non fibrous particles included therein was reduced so as to be about 3% by weight, and so that the included weight percentage of non fibrous particles with a diameter greater than or equal to 150 microns was brought to be about 0.3%. Thus, the parameters of this alumina-silica fiber material, which was of the amorphous type, were brought to be as given in Table 1, which is given at the end of the specification and before the claims thereof.

Further, a quantity of mineral fiber material of the type manufactured by the Jim Walter Resources Company, with trade name "PMF" (Processed Mineral Fiber), having a nominal composition of 45% by weight of $SiO_2$, 38% by weight of CaO, 9% by weight of $Al_2O_3$, and remainder 2%, with a quantity of non fibrous material intermingled therewith, was similarly subjected to per se known particle elimination processing such as filtration or the like, so that the total amount of non fibrous particles was brought to be about 2.5% by weight, and so that the included weight percentage of non fibrous particles with a diameter greater than or equal to 150 microns was about 0.1%; thus, the parameters of this mineral fiber material were as given in Table 2, which is given at the end of this specification and before the claims thereof.

Figure 1:
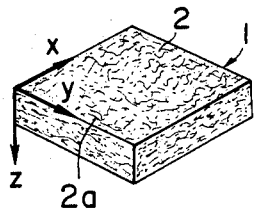
FIG. 1 is a perspective view showing a preform made of amorphous alumina-silica fibers and mineral fibers stuck together with a binder, said preform being generally cuboidal, and particularly indicating the non isotropic orientation of said fibers.

Next, using samples of these quantities of amorphous alumina-silica fibers and of mineral fibers, there were formed five preforms which will be designated as A0, A20, A40, A60, and A100, in the following way. For each preform, first, a quantity of the amorphous alumina-silica fibers with composition as per Table 1 and a quantity of the mineral fibers with composition as per Table 2 were dispersed together in colloidal silica, which acted as a binder: the relative proportions of the amorphous alumina-silica fibers and of the mineral fibers were different in each case (and in one case no amorphous alumina-silica fibers were utilized, while in another case no mineral fibers were utilized). In each case, the mixture was then well stirred up so that the alumina-silica fibers and the mineral fibers were evenly dispersed therein and were well mixed together, and then the preform was formed by vacuum forming from the mixture, said preform having dimensions of 80 by 80 by 20 millimeters, as shown in perspective view in FIG. 1, wherein it is designated by the reference numeral 1. As suggested in FIG. 1, the orientation of the individual amorphous alumina-silica fibers 2 and of the individual mineral fibers 2*a* in these preforms 1 was not isotropic in three dimensions: in fact, these amorphous alumina-silica fibers 2 and these mineral fibers 2*a* were largely oriented parallel to the longer sides of the cuboidal performs 1, i.e. in the x-y plane as shown in FIG. 1, and were substantially randomly oriented in this plane; but said fibers 2 and 2*a* did not extend very substantially in the z direction as seen in FIG. 1, and were, so to speak, somehat stacked on one another with regard to this direction. Finally, each preform was fired in a furnace at about 600° C., so that the silica bonded together the individual amorphous alumina-silica fibers 2 and mineral fibers 2*a* acting as a binder.

Figure 3:
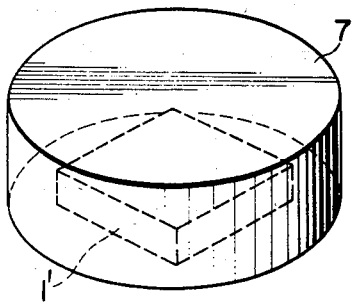
FIG. 3 is a perspective view of a solidified cast lump of matrix metal with said preform of FIG. 1 shown by phantom lines in its interior, as removed from the FIG. 2 apparatus after having been cast therein.
Figure 2:
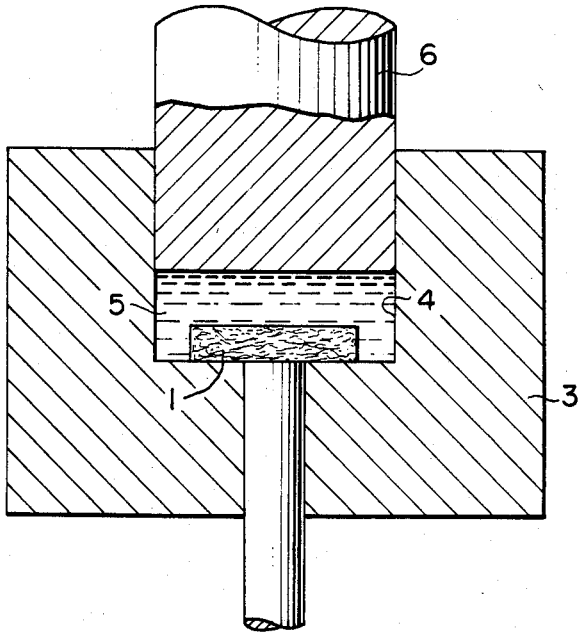
FIG. 2 is a schematic sectional diagram showing a mold with a mold cavity, and a pressure piston which is being forced into said mold cavity in order to pressurize molten matrix metal around the preform of FIG. 1 which is being received in said mold cavity, during a casting stage of a process of manufacture of the composite material of the present invention.

Next, a casting process was performed on each of the preforms, as schematically shown in section in FIG. 2. In turn, each of the preforms 1 was placed into the mold cavity 4 of a casting mold 3, and then a quantity of molten metal for serving as the matrix metal for the resultant composite material, in the case of this first preferred embodiment being molten aluminum alloy of type JIS (Japan Industrial Standard) AC8A and being heated to about 730° C., was poured into the mold cavity 4 over and arond the preform 1. Then a piston 6, which closely cooperated with the defining surface of the mold cavity 4, was forced into said mold cavity 4 and was forced inwards, so as to pressurize the molten matrix metal to a pressure of about 1500 kg/cm$^2$ and thus to force it into the interstices between the fibers 2 and 2*a* of the preform 1. This pressure was maintained until the mass 5 of matrix metal was completely solidified, and then the resultant cast form 7, schematically shown in FIG. 3, was removed from the mold cavity 4. This cast form 7 was cylindrical, with diameter about 110 millimeters and height about 50 millimeters. Finally, heat treatment of type T7 was applied to this cast form 7, and from the part 1' of it (shown by phantom lines in FIG. 3) in which the fiber preform 1 was embedded was cut a test piece of composite material incorporating amorphous alumina-silica fibers and mineral fibers as the reinforcing fiber material and aluminum alloy as the matrix metal, of dimensions correspondingly again about 80 by 80 by 20 millimeters; thus, in all, five such test pieces of composite material were manufactured, each corresponding to one of the preforms A0 through A100, and each of which will be hereinafter referred to by the reference symbol A0 through A100 of its parent preform since no confusion will arise therefrom. The parameters of these five pieces of composite material are shown in Table 3, which is given at the end of this specification and before the claims thereof: in particular, for each composite material piece, the total volume proportion of the reinforcing fiber material is shown, along with the volume proportion of the amorphous alumina-silica fibers and the volume proportion of the mineral fibers, the ratio between which is seen to be varied between zero and infinity. It will be seen from this table that the total reinforcing fiber volume proportion was substantially equal to about 9.8% (or roughly 10%), for each of the five composite material sample pieces. As will be understood from the following, this set of test pieces included one or more preferred embodiments of the present invention and one or more comparison samples which were not embodiments of the present invention. From each of these test pieces was machined a wear test block sample, each of which will also be hereinafter referred to by the reference symbol A0 through A100 of its parent preform.

In turn, each of these five wear test sample pieces A0 through A100 was mounted in a LFW friction wear test machine, and its test surface was brought into contact with the outer cylindrical surface of a mating element, which was a cylinder of spheroidal graphite cast iron of type JIS (Japanese Industrial Standard) FCD70. While supplying lubricating oil (Castle Motor Oil (this is a trademark) of grade 5W-30) at a temperature of about 20° C. to the contacting surfaces of the test pieces, in each case a friction wear test was carried out by rotating the cylindrical mating element for one hour, using a contact pressure of about 20 kg/mm$^2$ and a relative sliding speed of about 0.3 meters per second. It should be noted that in these wear tests the surface of the test piece which was contacted to the mating element was a plane perpendicular to the x-y plane as shown in FIG. 1.

Figure 4:
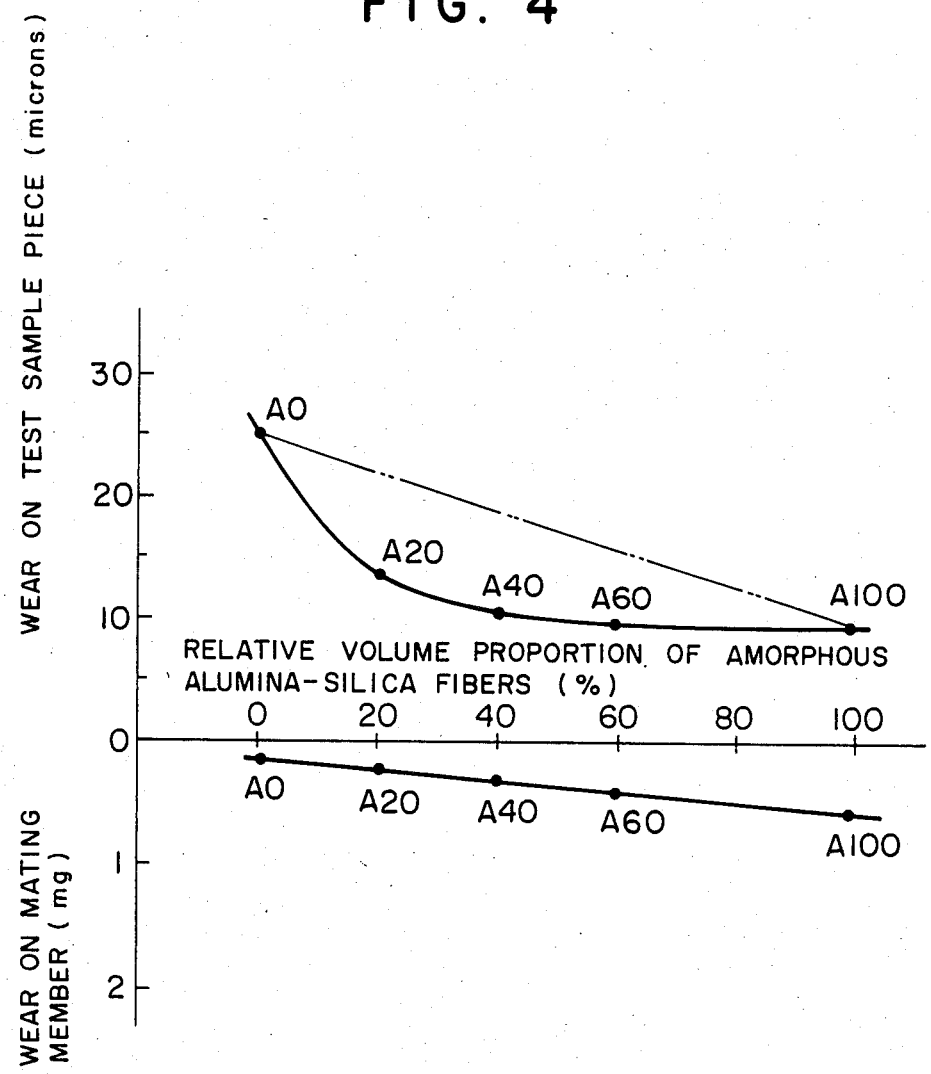
FIG. 4 is a graph in which, for each of five test sample pieces A0 through A100 thus made from five various preforms like the FIG. 1 preform, during a wear test in which the mating member was a spherical graphite cast iron cylinder, the upper half shows along the vertical axis the amount of wear on the actual test sample of composite material in microns, and the lower half shows along the vertical axis the amount of wear on said spherical graphite cast iron mating member in milligrams, while the volume proportion in percent of the total reinforcing fiber volume incorporated in said sample pieces which consists of amorphous alumina-silica fibers is shown along the horizontal axis; and this figure also shows by a double dotted line a theoretical wear amount characteristic based upon the so called compounding rule.

The results of these friction wear tests are shown in FIG. 4. In this figure, which is a two sided graph, for each of the five wear test samples A0 through A100, the upper half shows along the vertical axis the amount of wear on the actual test sample of composite material in microns, and the lower half shows along the vertical axis the amount of wear on the mating member (i.e., the spheroidal graphite cast iron cylinder) in milligrams. And the volume proportion in percent of the total reinforcing fiber volume incorporated in said sample pieces which consists of amorphous alumina-silica fibers, i.e. the so called relative volume proportion of amorphous alumina-silica fibers, is shown along the horizontal axis.

Now, from this FIG. 4, it will be understood that the wear amount of the test piece dropped along with increase in the relative volume proportion of amorphous alumina-silica fibers incorporated in said test piece, and particularly dropped very quickly along with increase in said relative volume proportion when said relative volume proportion was in the range of 0% to about 30%, i.e. in the range of fairly low relative volume proportion of amorphous alumina-silica fibers, but on the other hand had a relatively small variation when said relative volume proportion of amorphous alumina-silica fibers was greater than about 40%. On the other hand, the wear amount of the mating member (the spheroidal graphite cast iron cylinder) was substantially independent of the relative volume proportion of amorphous alumina-silica fibers, and was fairly low in all cases.

Now, it is sometimes maintained that the construction and composition of a composite material are subject to design criteria according to structural considerations. In such a case, the so called compounding rule would be assumed to hold. If this rule were to be applied to the present case, taking X% to represent the relative volume proportion of the amorphous alumina-silica fibers incorporated in each of said test samples, as defined above, since when X% was equal to 0% the wear amount of the test sample piece was equal to about 25 microns, whereas when X% was equal to 100% the wear amount of the test sample piece was equal to about 10 microns, then by the compounding rule the wear amount Y of the block test piece for arbitrary values of X% would be determined by the equation:

$$Y=(25-10)x/100+10$$

This is just a linear fitting. Now, the double dotted line in FIG. 4 shows this linear approximation, and it is immediately visible that there is a great deviation dY between this linear approximation derived according to the compounding rule and the actual measured values for wear on the test samples. In short, the compounding rule is inapplicable, and this compound material at least is not subject to design criteria according to structural considerations.

Figure 5:
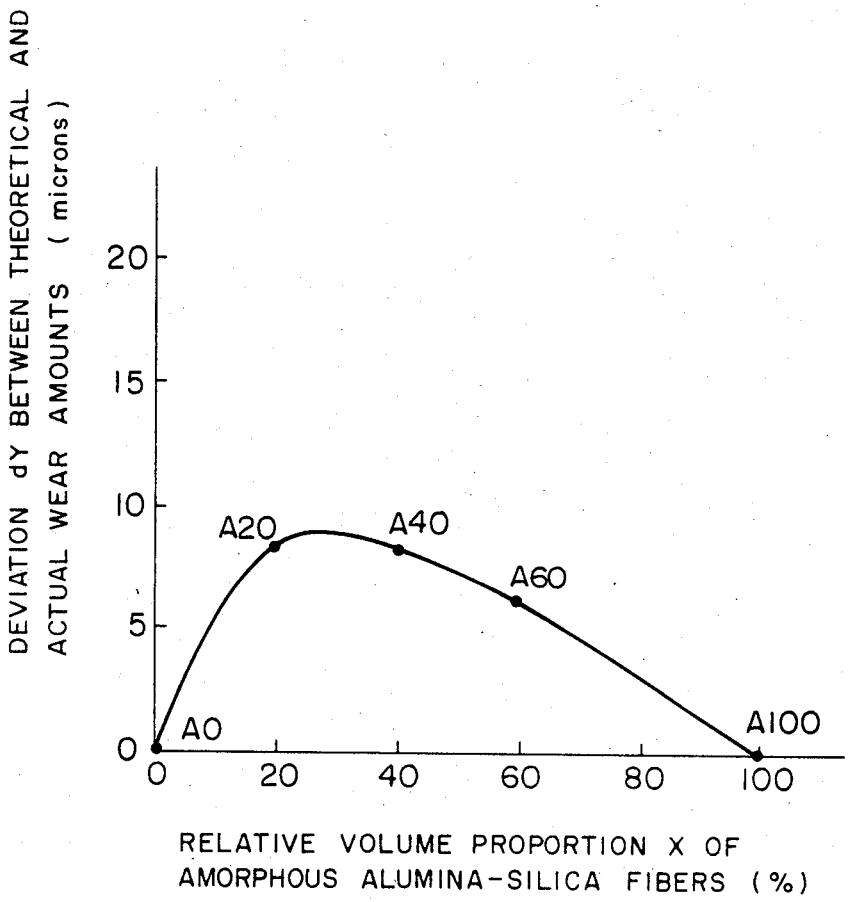
FIG. 5 is a graph in which, for each of said five test sample pieces A0 through A100, the deviation dY between the thus theoretically calculated wear amount and the actual wear amount is shown along the vertical axis in microns, and the volume proportion X in percent of the total reinforcing fiber volume incorporated in said sample pieces which consists of amorphous alumina-silica fibers is shown along the horizontal axis.

In more detail, in FIG. 5, the value of this deviation dY between the linear approximation derived according to the compounding rule and the actual measured wear values is shown plotted on the vertical axis, while the relative volume proportion of the amorphous alumina-silica fibers incorporated in the test samples is shown along the horizontal axis. From this figure, is is confirmed that when the relative volume proportion of the amorphous alumina-silica fibers is in the range of 5% to 80%, and particularly when said relative volume proportion of the amorphous alumina-silica fibers is in the range of 10% to 60%, the actual wear amount of the test sample piece is very much reduced from the wear amount value predicted by the compounding rule. This effect is thought to be due to the hybridization of the amorphous alumina-silica fibers and the mineral fibers in this type of composite material. Accordingly, from these test results, it is considered that, from the point of view of wear on a part or finished member made of the composite material according to the present invention, it is desirable that the relative volume proportion of the amorphous alumina-silica fibers in the hybrid fiber mixture material incorporated as fibrous reinforcing material for the composite material according to this invention should be in the range of 5% to 80%, and preferably should be in the range of 10% to 60%.

Tests Related to the Second Preferred Embodiment Use of Magnesium Alloy Matrix Metal A quantity of alumina-silica fiber material of a type manufactured by Mitsubishi Kasei KK, having a nominal composition of 72% by weight of $Al_2O_3$ and 28% by weight of $SiO_2$, with a quantity of non fibrous material intermingled therewith, was subjected to per se known particle elimination processing such as filtration or the like, so that the total proportion of non fibrous particles included therein was reduced so as to be about 1% by weight, and so that the included weight of non fibrous particles with a diameter greater than or equal to 150 microns was about 0.1%. Thus, the parameters of this alumina-silica fiber material, which was of the amorphous type, were brought to be as given in Table 4, which is given at the end of this specification and before the claims thereof.

Further, a quantity of mineral fiber material of the type manufactured by Nitto Boseki KK, with trade name "Microfiber", having a nominal composition of 40% by weight of $SiO_2$, 39% by weight of CaO, 15% by weight of $Al_2O_3$, and 6% by weight of MgO, with a quantity of non fibrous material intermingled therewith, was similarly subjected to per se known particle elimination processing such as filtration or the like, so that the total amount of non fibrous particles includes therein was brought to be about 1.0% by weight, and so that the included weight percentage of non fibrous particles with a diameter greater than or equal to 150 microns was about 0.1%; thus, the parameters of this mineral fiber material were brought to be as given in Table 5, which is given at the end of this specification and before the claims thereof.

Next, using samples of these quantities of amorphous alumina-silica fibers and of mineral fibers, there were formed five preforms which will be designated as B0, B20, B40, B60, and B100, in a similar way to that practiced in the case of the first preferred embodiment described above. For each preform, first, a quantity of the amorphous alumina-silica fibers with composition as per Table 4 and a quantity of the mineral fibers with composition as per Table 5 were dispersed together in colloidal silica, which acted as a binder, with the relative proportions of the alumina-silica fibers and of the mineral fibers being different in each case. In each case, the mixture was then well stirred up so that the amorphous alumina-silica fibers and the mineral fibers were evenly dispersed therein and were well mixed together, and then the preform as shown in FIG. 1 was formed by vacuum forming from the mixture, said preform again having dimensions of 80 by 80 by 20 millimeters. Again, in these preforms 1, the individual amorphous alumina-silica fibers 2 and the individual mineral fibers **2*a* were largely oriented parallel to the longer sides of the cuboidal preforms 1, i.e. in the x-y plane as shown in FIG. 1**, and were substantially randomly oriented in this plane. Finally, each preform was fired in a furnace at about 600° C., so that the silica bonded together the individual alumina-silica fibers 2 and mineral fibers 2*a*, acting as a binder.

Next, as in the case of the first preferred embodiment, a casting process was performed on each of the preforms, as schematically shown in section in FIG. 2. In turn, each of the preforms 1 was placed into the mold cavity 4 of the casting mold 3, and then a quantity of molten metal for serving as the matrix metal for the resultant composite material, in the case of this second preferred embodiment being molten magnesium alloy of type JIS (Japan Industrial Standard) AZ91 and this time being heated to about 690° C., was poured into the mold cavity 4 over and arond the preform 1. Then a piston 6, which closely cooperated with the defining surface of the mold cavity 4, was forced into said mold cavity 4 and was forced inwards, so as to pressurize the molten matrix metal to a pressure again of about 1500 kg/cm$^2$ and thus to force it into the interstices between the fibers 2 and 2*a* of the preform 1. This pressure was maintained until the mass 5 of matrix metal was completely solidified, and then the resultant cast form 7, schematically shown in FIG. 3, was removed from the mold cavity 4. This cast form 7 was cylindrical, with diameter about 110 millimeters and height about 50 millimeters. Finally, from the part 1' of this cast form 7 (shown by phantom lines in FIG. 3) in which the fiber preform 1 was embedded was cut a test piece of composite material incorporating amorphous alumina-silica fibers and mineral fibers as the reinforcing fiber material and magnesium alloy as the matrix metal, of dimensions correspondingly again about 80 by 80 by 20 millimeters; thus, in all, five such test pieces of composite material were manufactured, each corresponding to one of the preforms B0 through B100, and each of which will be hereinafter referred to by the reference symbol B0 through B100 of its parent preform since no confusion will arise therefrom. The parameters of these five pieces of composite material are shown in Table 6, which is given at the end of this specification and before the claims thereof: in particular, for each composite material piece, the total volume proportion of the reinforcing fiber material is shown, along with the volume proportion of the amorphous alumina-silica fibers and the volume proportion of the mineral fibers, the ratio between which is seen to be varied between zero and infinity. It will be seen from this table that the total reinforcing fiber volume proportion was substantially equal to about 20%, for each of the five composite material sample pieces. As will be understood from the following, this set of test pieces included one or more preferred embodiments of the present invention and one or more comparison samples which were not embodiments of the present invention. From each of these test pieces was machined a wear test block sample, each of which will also be hereinafter referred to by the reference symbol B0 through B100 of its parent preform.

Figure 6:
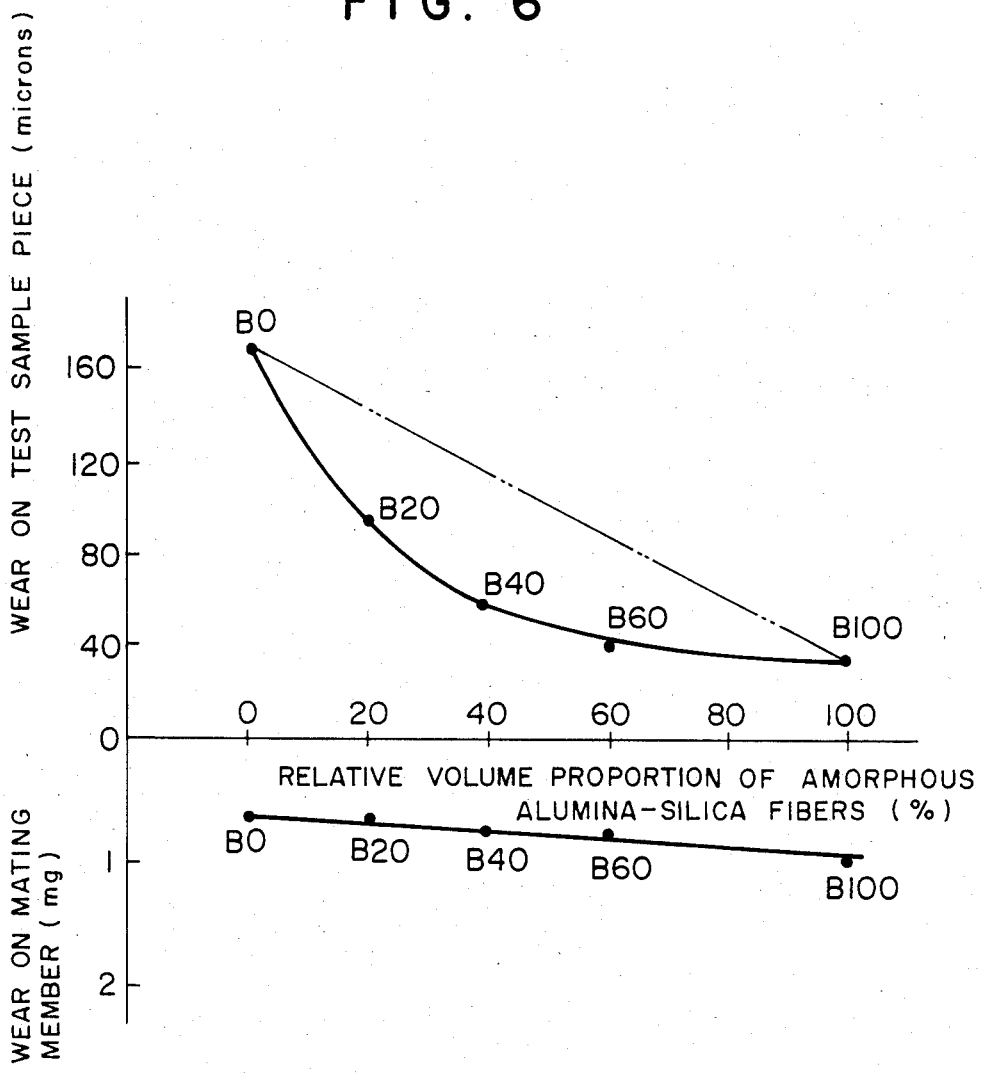
FIG. 6 is similar to FIG. 4, and is a graph in which, for each of five other test sample pieces B0 through B100, during another wear test in which the mating member was a bearing steel cylinder, the upper half shows along the vertical axis the amount of wear on the actual test sample of composite material in microns, and the lower half shows along the vertical axis the amount of wear on said bearing steel mating member in milligrams, while the volume proportion in percent of the total reinforcing fiber volume incorporated in said sample pieces which consists of amorphous alumina-silica fibers is shown along the horizontal axis; and also this figure again also shows by a double dotted line a theoretical wear amount characteristic.

In turn, each of these five wear test samples B0 through B100 was mounted in a LFW friction wear test machine, and was subjected to a wear test under the same test conditions as in the case of the first preferred embodiment described above, except that the mating element employed was a cylinder of quench tempered bearing steel of type JIS (Japanese Industrial Standard) SUJ2, of hardness about 810 Hv. The results of these friction wear tests are shown in FIG. 6. In this figure, which is a two sided graph similar to FIG. 4, for each of the wear test samples B0 through B100, the upper half shows along the vertical axis the amount of wear on the actual test sample of composite material in microns, and the lower half shows along the vertical axis the amount of wear on the mating member (i.e., the quench tempered bearing steel cylinder) in milligrams. And the volume proportion in percent of the total reinforcing fiber volume incorporated in said sample pieces which consists of amorphous alumina-silica fibers, i.e. the so called relative volume proportion of amorphous alumina-silica fibers, is shown along the horizontal axis.

Now, from this FIG. 6, it will be understood that, also in the case in which the mating element was a bearing steel member, the wear amount of the test piece dropped along with increase in the relative volume proportion of the amorphous alumina-silica fibers incorporated in said test piece, and particularly dropped very quickly along with increase in said relative volume proportion when said relative volume proportion was in the range of 0% to about 40%, i.e. in the range of fairly low relative volume proportion of amorphous alumina-silica fibers, but on the other hand had a relatively small variation when said relative volume proportion of amorphous alumina-silica fibers was greater than about 60%. On the other hand, the wear amount of the mating member (the bearing steel cylinder) was substantially independent of the relative volume proportion of amorphous alumina-silica fibers, and was fairly low in all cases. Further, by a comparison of this second preferred embodiment which utilized as cooperating member a bearing steel cylinder with the first preferred embodiment described above which utilized as cooperating member a spheroidal graphite cast iron cylinder, it will be understood that, in the case of using such spheroidal graphite cast iron as the material for the cooperating member, since such spheroidal graphite cast iron has a certain self lubricating property and has superior lubricating quality, the total amount of reinforcing fibers may be much reduced.

Figure 7:
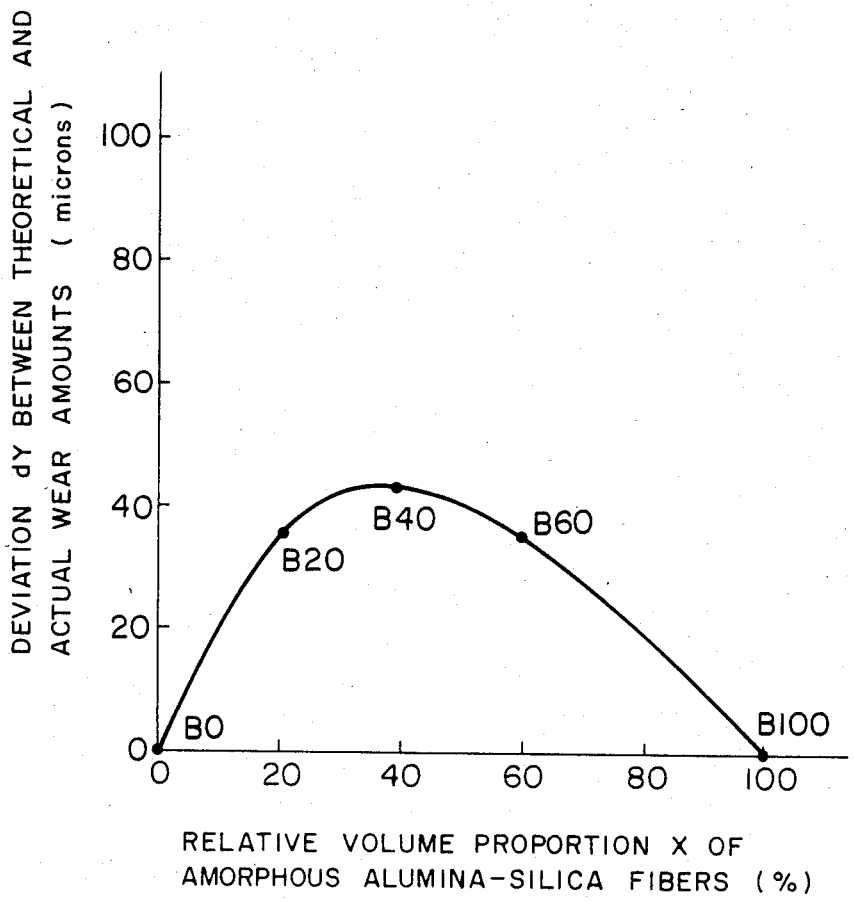
FIG. 7 is similar to FIG. 5, and is a graph in which, for each of said five test sample pieces B0 through B100, the deviation dY between the thus theoretically calculated wear amount and the actual wear amount is shown along the vertical axis in microns, and the volume proportion X in percent of the total reinforcing fiber volume incorporated in said sample pieces which consists of amorphous alumina-silica fibers is shown along the horizontal axis.

Again, with reference to the so called compounding rule, if this rule were to be applied to the present case, the same type of linear fitting as shown in FIG. 6 by the double dotted line would be obtained. Again, it is immediately visible that there is a great deviation dY between this linear approximation derived according to the compounding rule and the actual measured values for wear on the test samples. In FIG. 7 (which is similar to FIG. 5), the value of this deviation dY between the linear approximation derived according to the compounding rule and the actual measured wear values for this second preferred embodiment is shown plotted on the vertical axis, while the relative volume proportion of the amorphous alumina-silica fibers incorporated in the test samples is shown along the horizontal axis. From this figure is is confirmed that, when the relative volume proportion of the amorphous alumina-silica fibers is in the range of 10% to 80%, the actual wear amount of the test sample piece is very much reduced from the wear amount value predicted by the compounding rule. Again, this effect is thought to be due to the hybridization of the amorphous alumina-silica fibers and the mineral fibers in this type of composite material.

Tests Relating to the Third Preferred Embodiment

A quantity of alumina-silica fiber material of a type having a nominal composition of 49% by weight of $Al_2O_3$ and 51% by weight of $SiO_2$, with a quantity of non fibrous material intermingled therewith, was subjected to per se known particle elimination processing such as filtration or the like, so that the total proportion of non fibrous particles included therein was reduced so as to be about 2% by weight, and so that the included weight of non fibrous particles with a diameter greater than or equal to 150 microns was about 0.2%. Thus, the parameters of this alumina-silica fiber material, which was of the amorphous type, were brought to be as given in Table 7, which is given at the end of this specification and before the claims thereof.

Further, a quantity of mineral fiber material of the type used in the first preferred embodiment described above, of the type manufactured by the Jim Walter Resources Company, with trade name "PMF" (Processed Mineral Fiber), having a nominal composition of 45% by weight of $SiO_2$, 38% by weight of CaO, 9% by weight of $Al_2O_3$, and remainder 2%, with a quantity of non fibrous material intermingled therewith, was as in the first preferred embodiment subjected to per se known particle elimination processing such as filtration or the like, so that the total amount of non fibrous particles included therein was brought to be about 2.5% by weight, and so that the included weight percentage of non fibrous particles with a diameter greater than or equal to 150 microns was about 0.1%; thus, the parameters of this mineral fiber material were again brought to be as previously given in Table 2.

Next, using samples of these quantities of amorphous alumina-silica fibers and of mineral fibers, there were formed six preforms which will be designated as C0, C20, C40, C60, C80, and C100, in a similar way to that practiced in the case of the first preferred embodiment described above. As before, for each preform, a quantity of the alumina-silica fibers with composition as per Table 7 and a quantity of the mineral fibers with composition as per Table 2 were well and evenly mixed together in colloidal silica in various different volume proportions, and then the preform as shown in FIG. 1 was formed by vacuum forming from the mixture, said preform again having dimensions of 80 by 80 by 20 millimeters. Again, in these preforms 1, the alumina-silica fibers 2 and the mineral fibers 2*a* were largely oriented parallel to the longer sides of the cuboidal preforms 1, i.e. in the x-y plane as shown in FIG. 1, and were substantially randomly oriented in this plane. Finally, again, each preform was fired in a furnace at about 600° C., so that the silica bonded together the individual alumina-silica fibers 2 and mineral fibers 2*a*, acting as a binder.

Next, as in the case of the first and second preferred embodiments, a casting process was performed on each of the preforms, as schematically shown in FIG. 2, using as the matrix metal for the resultant composite material, in the case of this third preferred embodiment, molten aluminum alloy of type JIS (Japan Industrial Standard) AC8A, which in this case was heated to about 730° C., and pressurizing this molten matrix metal by the piston 6 to a pressure again of about 1500 $kg/cm^2$, so as to force it into the interstices between the fibers 2 and 2*a* of the preform 1. This pressure was maintained until the mass 5 of matrix metal was completely solidified, and then the resultant cast form 7, schematically shown in FIG. 3, was removed from the mold cavity 4. This cast form 7 again was cylindrical, with diameter about 110 millimeters and height about 50 millimeters. Finally, from the part 1' of the cast form 7 (shown by phantom lines in FIG. 3) in which the fiber preform 1 was embedded was cut a test piece of composite material incorporating amorphous alumina-silica fibers and mineral fibers as the reinforcing fiber material and aluminum alloy as the matrix metal, of dimensions correspondingly again about 80 by 80 by 20 millimeters; thus, in all, this time, six such test pieces of composite material were manufactured, each corresponding to one of the preforms C0 through C100, and each of which will be hereinafter referred to by the reference symbol C0 through C100 of its parent preform since no confusion will arise therefrom. The parameters of these six pieces of composite material are shown in Table 8, which is given at the end of this specification and before the claims thereof: in particular, for each composite material piece, the total volume proportion of the reinforcing fiber material is shown, along with the volume proportion of the amorphous alumina-silica fibers and the volume proportion of the mineral fibers, the ratio between which is again seen to be varied between zero and infinity. It will be seen from this table that the total reinforcing fiber volume proportion was substantially equal to about 79%, for each of the six composite material sample pieces. As will be understood from the following, this set of test pieces included one or more preferred embodiments of the present invention and one or more comparison samples which were not embodiments of the present invention. From each of these test pieces was machined a wear test block sample, each of which will also be hereinafter referred to by the reference symbol C0 through C100 of its parent preform.

Figure 8:
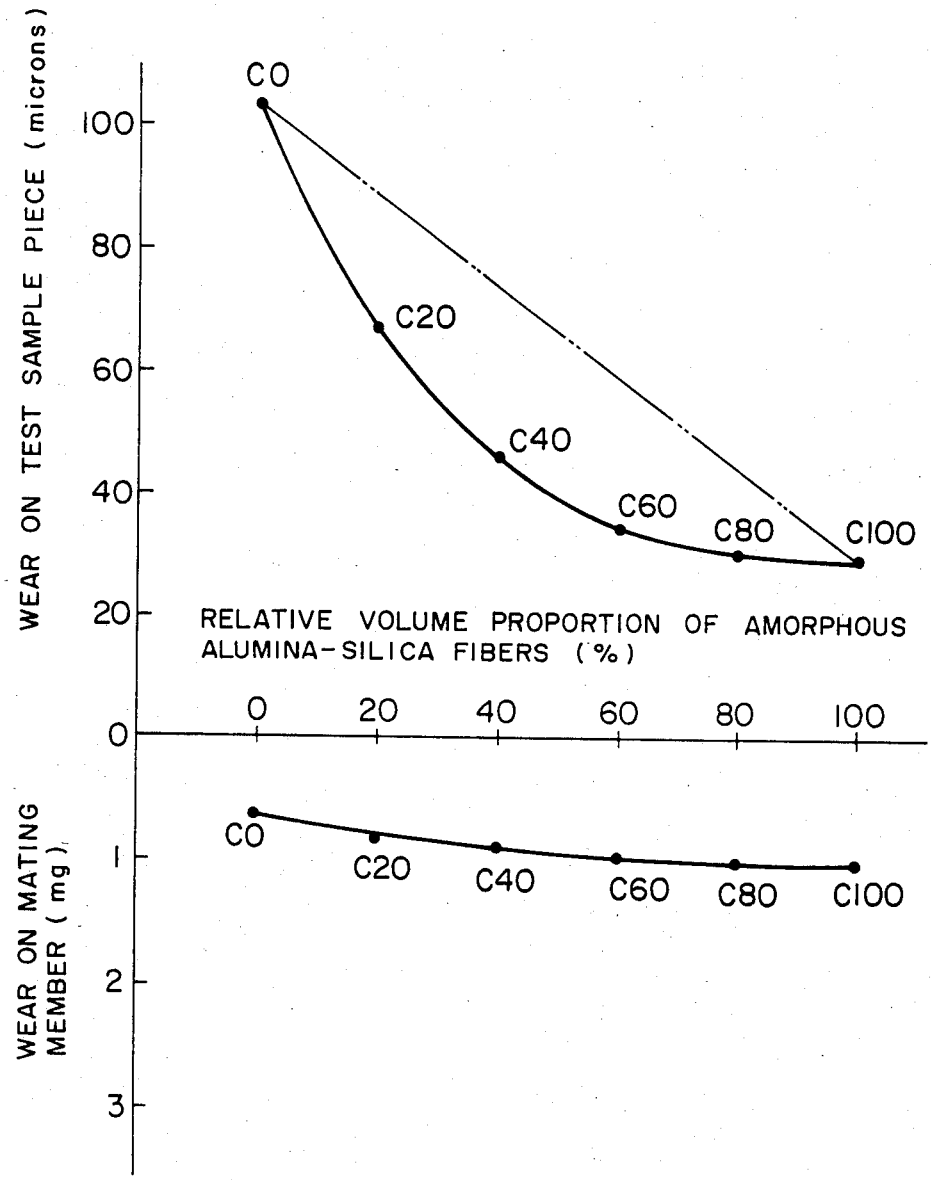
FIG. 8 is similar to the graphs of FIGS. 4 and 6, and is a graph in which, for each of six other test sample pieces C0 through C100, during another wear test in which the mating member was a steel cylinder, the upper half shows along the vertical axis the amount of wear on the actual test sample of composite material in microns, and the lower half shows along the vertical axis the amount of wear on said bearing steel mating member in milligrams, while the volume proportion in percent of the total reinforcing fiber volume incorporated in said sample pieces which consists of amorphous alumina-silica fibers is shown along the horizontal axis; and also this figure again also shows by a double dotted line a theoretical wear amount characteristic.

In turn, each of these six wear test samples C0 through C100 was mounted in a LFW friction wear test machine, and was subjected to a wear test under the same test conditions as in the case of the first preferred embodiment described above, using however as in the case of that embodiment a mating element which was a cylinder of bearing steel of type JIS (Japanese Industrial Standard) SUJ2, with hardness Hv equal to about 810. The results of these friction wear tests are shown in FIG. 8. In this figure, which is a two sided graph similar to FIGS. 4 and 6, for each of the wear test samples C0 through C100, the upper half shows along the vertical axis the amount of wear on the actual test sample of composite material in microns, and the lower half shows along the vertical axis the amount of wear on the mating member (i.e., the bearing steel cylinder) in milligrams. And the volume proportion in percent of the total reinforcing fiber volume incorporated in said sample pieces which consists of amorphous alumina-silica fibers, i.e. the so called relative volume proportion of amorphous alumina-silica fibers, is shown along the horizontal axis.

Now, from this FIG. 8, it will be understood that, also in this third preferred embodiment case in which the mating element was a bearing steel cylinder, the wear amount of the test piece dropped along with increase in the relative volume proportion of the amorphous alumina-silica fibers incorporated in said test piece, and particularly dropped very quickly along with increase in said relative volume proportion when said relative volume proportion was in the range of 0% to about 60%, i.e. in the range of fairly low relative volume proportion of amorphous alumina-silica fibers, but on the other hand had a relatively small variation when said relative volume proportion of amorphous alumina-silica fibers was greater than about 60%. On the other hand, the wear amount of the mating member (the bearing steel cylinder) was substantially independent of the relative volume proportion of amorphous alumina-silica fibers, and was fairly low in all cases, as with the first two preferred embodiments described above.

Figure 9:
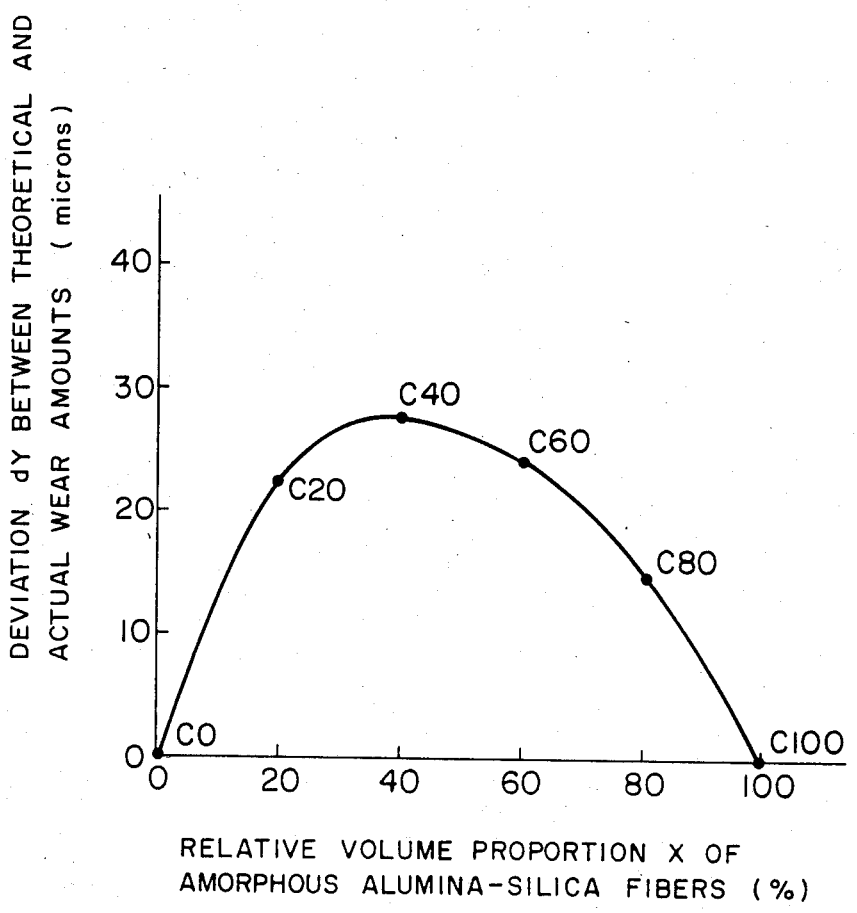
FIG. 9 is similar to the graphs of FIGS. 5 and 7, and is a graph in which, for each of said seven test sample pieces C0 through C100, the deviation dY between the thus theoretically calculated wear amount and the actual wear amount is shown along the vertical axis in microns, and the volume proportion X in percent of the total reinforcing fiber volume incorporated in said sample pieces which consists of amorphous alumina-silica fibers is shown along the horizontal axis.

Again, with reference to the so called compounding rule, if this rule were to be applied to the present case, the same type of linear fitting as shown in FIG. 8 by the double dotted line would be obtained. Again, it is immediately visible that there is a great deviation dY between this linear approximation derived according to the compounding rule and the actual measured values for wear on the test samples. In FIG. 9 (which is similar to FIGS. 5 and 7), the value of this deviation dY between the linear approximation derived according to the compounding rule and the actual measured wear values for this third preferred embodiment is shown plotted on the vertical axis, while the relative volume proportion of the amorphous alumina-silica fibers incorporated in the test samples is shown along the horizontal axis. From this figure is is confirmed that, when the relative volume proportion of the amorphous alumina-silica fibers is in the range of 10% to 80%, the actual wear amount of the test sample piece is very much reduced from the wear amount value predicted by the compounding rule. Again, this effect is thought to be due to the hybridization of the amorphous alumina-silica fibers and the mineral fibers in this type of composite material.

Tensile Strength Tests

From each of the five test pieces A0, A20, A40, A60, and A100 of composite material manufactured as described with respect to the first preferred embodiment, there was machined a bending strength test block sample, each of which will also be hereinafter referred to by the reference symbol A0 through A100 of its parent preform. Each of these bending strength test samples had dimensions about 50 mm by 10 mm by 2 mm, and its 50 mm by 10 mm surface was cut parallel to the x-y plane as seen in FIG. 1 of the composite material mass.

Next, each of these bending strength test samples A0 through A100 was subjected to a three point bending test at a temperature of about 350° C., with the gap between the support points being set to about 39 mm. Also, for purposes of comparison, a similar bending test was carried out upon a similarly cut piece of pure matrix metal, i.e. of aluminum alloy of type JIS (Japan Industrial Standard) AC8A, to which heat treatment of type T7 had been applied. The bending strength in each case was measured as the surface stress at breaking point of the test piece M/Z (M is the bending moment at breaking point, and Z is the cross sectional coefficient of the bending strength test sample piece). The results of these bending strength tests are shown in FIG. 10, which is a graph showing bending strength for each of the five bending test samples A0 through A100 and for the comparison test sample piece, with the volume proportion in percent of the total reinforcing fiber volume incorporated in said bending strength test sample pieces which consists of amorphous alumina-silica fibers, i.e. the so called relative volume proportion of amorphous alumina-silica fibers, shown along the horizontal axis, and with the corresponding bending strength in $kg/mm^2$ shown along the vertical axis.

Figure 10:
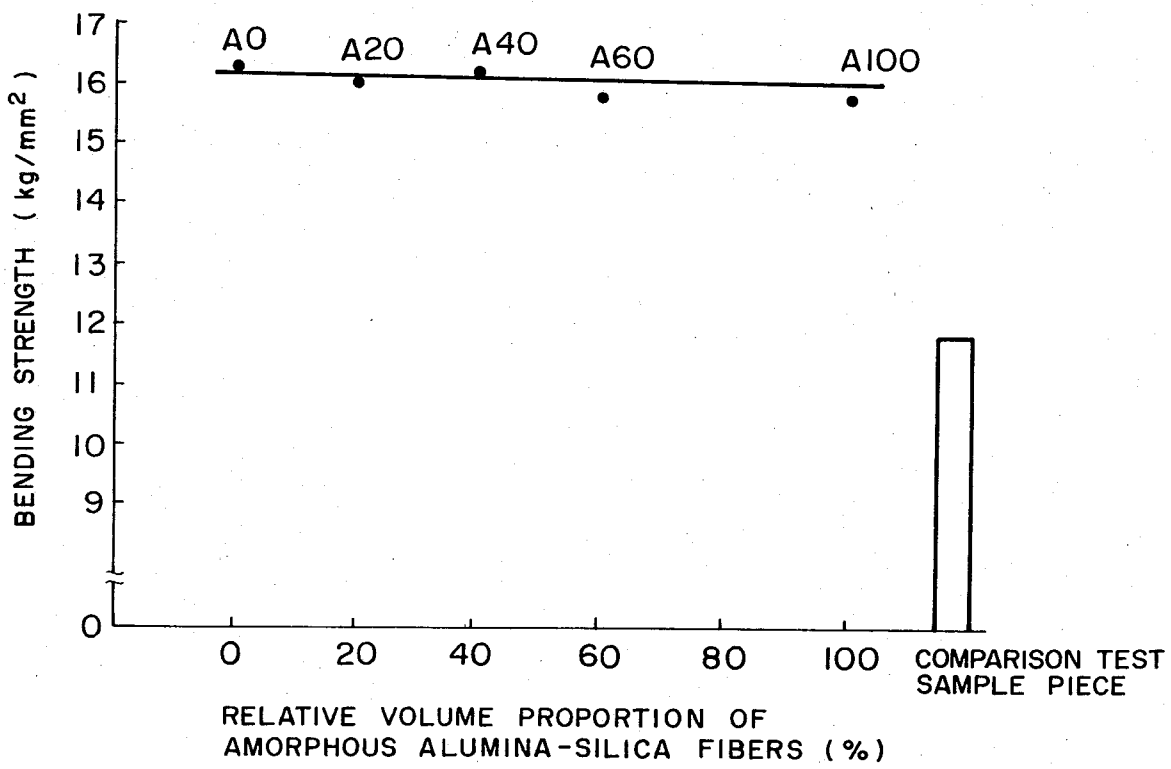
FIG. 10 is a graph relating to bending strength tests of five other test samples made from the same material as the first test samples A0 through A100, showing bending strength in $kg/mm^2$ along the vertical axis, and showing the volume proportion in percent of the total reinforcing fiber volume incorporated in said sample pieces which consists of amorphous alumina-silica fibers along the horizontal axis, and also showing for comparison the bending strength of a comparison sample piece which is composed only of pure aluminum alloy matrix metal without any reinforcing fibers.

From this graph in FIG. 10, it will be apparent that, even in this case when the total volume proportion of the reinforcing fibers was relatively low and equal to about 10%, nevertheless the bending strength of the test sample pieces was relatively high, much higher than that of the comparison piece made of aluminum alloy matrix metal on its own. It will also be understood that the bending strength of the test sample pieces was substantially independent of the relative volume proportion of amorphous alumina-silica fibers included therein.

Tests Relating to the Use of Other Matrix Metals

In the same way and under the same conditions as in the case of the first preferred embodiment described above, a quantity of amorphous alumina-silica fiber material of the type manufactured by Isolite Babcock Taika K.K Company, with trade name "Kaowool", having a nominal composition of 39% by weight of $Al_2O_3$ and 60% by weight of $SiO_2$ (remainder impurities), with a quantity of non fibrous material intermingled therewith, was subjected to particle elimination processing, so that the total proportion of non fibrous particles included therein was reduced so as to be about 3% by weight, and so that the included weight percentage of non fibrous particles with a diameter greater than or equal to 150 microns was reduced to be equal to about 0.3%; thus the parameters of this amorphous alumina-silica fiber material were again as shown in Table 1. Further, as in the first preferred embodiment, a quantity of mineral fiber material of the type manufactured by the Jim Walter Resources Company, with trade name "PMF" (Processed Mineral Fiber), having a nominal composition of 45% by weight of $SiO_2$, 38% by weight of CaO, 9% by weight of $Al_2O_3$, and remainder 2%, with a quantity of non fibrous material intermingled therewith, was subjected to per se known particle elimination processing such as filtration or the like, so that the total amount of non fibrous particles was brought to be about 2.5% by weight, and so that the included weight percentage of non fibrous particles with a diameter greater than or equal to 150 microns was about 0.1%; thus, the parameters of this mineral fiber material again were as given in Table 2. Next, quantities of these two fiber materials were mixed together in colloidal silica as in the case of the first preferred embodiment, and from this mixture three preforms were formed by the vacuum forming method, said preforms again having dimensions of 80 by 80 by 20 millimeters as before, and as before the preforms were fired in a furnace at about 600° C. The fiber volume proportion for each of these three preforms was about 15%, and the relative volume proportion of the amorphous alumina-silica fibers was about 30% in each case. And then high pressure casting processes were performed on the preforms, in substantially the same way as in the case described above of the first preferred embodiment, but this time using a pressure of only about 500 $kg/cm^2$ as the casting pressure in each case, and respectively using as the matrix metal zinc alloy of type JIS (Japanese Industrial Standard) ZDC1, pure lead (of purity 99.8%), and tin alloy of type JIS (Japanese Industrial Standard) WJ2, which were respectively heated to casting temperatures of about 500° C., about 410° C., and about 330° C. From the parts of the resulting cast masses in which the fiber preforms were embedded were then machined wear test samples of composite material incorporating a mixture of amorphous alumina-silica fibers and mineral fibers as the reinforcing fiber material and, respectively, zinc alloy, pure lead, and tin alloy as the matrix metal.

Then these wear samples were tested in substantially the same way and under the same operational conditions as in the case of the first preferred embodiment described above (except that the contact pressure was 5 $kg/mm^2$ and the period of test was about 30 minutes), using as the mating element a cylinder of bearing steel of type JIS (Japanese Industrial Standard) SUJ2, with hardness Hv equal to about 810. The results of these friction wear tests were that the amounts of wear on the test samples of these composite materials were respectively about 5%, about 2%, and about 3% of the wear amounts on test sample pieces made of only the corresponding matrix metal without any reinforcing fibers. Accordingly, it is concluded that by using this mixed reinforcing fiber material made up from amorphous alumina-silica fiber material and mineral fiber material as the fibrous reinforcing material for the composite material, also in these cases of using zinc alloy, lead, or tin alloy as matrix metal, the characteristics of the composite material with regard to wear resistance are very much improved, as compared to the characteristics of pure matrix metal only.

Although the present invention has been shown and described with reference to these preferred embodiments thereof, in terms of a portion of the experimental research carried out by the present inventors, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore, it is desired that the scope of the present invention, and the protection sought to be granted by Letters Patent, should be defined not by any of the perhaps purely fortuitous details of the shown preferred embodiments, or of the drawings, but solely by the scope of the appended claims, which follow.

TABLE 1

| | |
|---|---|
| Chemical composition (wt %) | $Al_2O_3$:39%, $SiO_2$:60% |
| Average fiber diameter (microns) | 4.2 |
| Average fiber length (mm) | 1 |
| Total amount of non fibrous particles (wt %) | 3 |
| Amount of non fibrous particles of diameter greater than or equal to 150 microns (wt %) | 0.3 |
| Crystalline form | Amorphous |

TABLE 2

| | |
|---|---|
| Chemical composition (wt %) | $SiO_2$:45%, CaO:38%, $Al_2O_3$:9%, MgO:6%, remainder 2% |
| Average fiber diameter (microns) | 5 |
| Average fiber length (mm) | 1.5 |
| Total amount of non fibrous particles (wt %) | 2.5 |
| Amount of non fibrous particles of diameter greater than or equal to 150 microns (wt %) | 0.1 |

TABLE 3

| Composite material sample | A0 | A20 | A40 | A60 | A100 |
|---|---|---|---|---|---|
| Total volume proportion of reinforcing fibers (%) | 9.8 | 9.9 | 9.7 | 10.0 | 9.7 |
| Volume proportion of amorphous alumina-silica fibers (%) | 0 | 2.0 | 3.9 | 6.0 | 9.7 |
| Volume proportion of mineral fibers (%) | 9.8 | 7.9 | 5.8 | 4.0 | 0 |
| Matrix metal | Aluminum alloy (JIS standard AC8A) | | | | |

TABLE 4

| | |
|---|---|
| Chemical composition (wt %) | $Al_2O_3$:72%, $SiO_2$:28% |
| Average fiber diameter (microns) | 2.8 |
| Average fiber length (mm) | 0.1 |
| Total amount of non fibrous particles (wt %) | 1 |
| Amount of non fibrous particles of diameter greater than or equal to 150 microns (wt %) | 0.1 |
| Crystalline from | Amorphous |

TABLE 5

| | |
|---|---|
| Chemical composition (wt %) | $SiO_2$:40%, CaO:39%, $Al_2O_3$:15%, MgO:6% |
| Average fiber diameter (microns) | 4.9 |
| Average fiber length (mm) | 0.05 |
| Total amount of non fibrous particles (wt %) | 1.0 |
| Amount of non fibrous particles of diameter greater than or equal to 150 microns (wt %) | 0.1 |

TABLE 6

| Composite material sample | B0 | B20 | B40 | B60 | B100 |
|---|---|---|---|---|---|
| Total volume proportion of reinforcing fibers (%) | 20.2 | 20.1 | 20.3 | 20.2 | 20.2 |
| Volume proportion of amorphous alumina-silica fibers (%) | 0 | 4.1 | 8.1 | 12.1 | 20.2 |
| Volume proportion of mineral fibers (%) | 20.2 | 16.0 | 12.2 | 8.1 | 0 |
| Matrix metal | Magnesium alloy (JIS standard AZ91) | | | | |

TABLE 7

| | |
|---|---|
| Chemical composition (wt %) | $Al_2O_3$:49%, $SiO_2$:51% |
| Average fiber diameter (microns) | 3.0 |
| Average fiber length (mm) | 3 |
| Total amount of non fibrous particles (wt %) | 2 |
| Amount of non fibrous particles of diameter greater than or equal to 150 microns (wt %) | 0.2 |
| Crystalline form | Amorphous |

TABLE 8

| Composite material sample | C0 | C20 | C40 | C60 | C80 | C100 |
|---|---|---|---|---|---|---|
| Total volume proportion of reinforcing fibers (%) | 6.9 | 7.0 | 7.0 | 7.1 | 6.9 | 7.0 |
| Volume proportion of amorphous alumina-silica fibers (%) | 0 | 1.4 | 2.8 | 4.3 | 5.6 | 7.0 |
| Volume proportion of mineral fibers (%) | 6.9 | 5.6 | 4.2 | 2.8 | 1.3 | 0 |
| Matrix metal | Aluminum alloy (JIS standard AC8A) | | | | | |

What is claimed is:

1. A composite material, consisting essentially of:

(a) a reinforcing material which is a hybrid fiber mixture material consisting essentially of:

(a1) an effective amount of a reinforcing amorphous alumina-silica fiber material with the principle components being about 35% to about 80% by weight of $Al_2A_3$ and about 65% to about 20% by weight of $SiO_2$, and with a content of other substances of less than or equal to about 10% by weight, with the percentage of non-fibrous particles included therein being less than or equal to about 17% by weight, and with the percentage of non-fibrous particles with diameters greater than about 150 microns included therein being less than or equal to about 7% by weight; and (a2) an effective amount of a reinforcing mineral fiber material having as the principle components $SiO_2$, CaO, and $Al_2O_3$, the content of included MgO therein being less than or equal to about 10% by weight, the content of included $Fe_2O_3$ therein being less than or equal to about 5% by weight, and the content of other inorganic substances included therein being less than or equal to about 10% by weight, with the percentage of non-fibrous particles included therein being less than or equal to about 20% by weight, and with the percentage of non-fibrous particles with diameters greater than about 150 microns included therein being less than or equal to about 7% by weight; and (b) a matrix metal selected from the group consisting of aluminum, magnesium, copper, zinc, lead, tin and alloys having these metals as principle components; wherein the volume of said hybrid fiber mixture material in said composite material is at least 1%.

2. The composite material according to claim 1, wherein the ratio of the volume proportion of said amorphous alumina-silica fiber material to the total volume proportion of said hybrid fiber mixture material is between about 5% and about 80%.

3. The composite material according to claim 2, wherein the ratio of the volume proportion of said amorphous alumina-silica fiber material to the total volume proportion of said hybrid fiber mixture material is between about 5% and about 40%, and the total volume proportion of said hybrid fiber mixture material is between about 2% and about 40%.

4. The composite material according to claim 1, wherein the volume proportion of said mineral fiber material in said composite material is less than or equal to about 25%.

5. The composite material according to claim 1, wherein the total proportion of non fibrous particles included in said amorphous alumina-silica fiber material is less than or equal to about 6% by weight, and the proportion of non fibrous particles with diameters greater than about 150 microns included in said amorphous alumina-silica fiber material is less than or equal to about 1% by weight.

6. The composite material according to claim 1, wherein the total proportion of non fibrous particles included in said mineral fiber material is less than or equal to about 10% by weight, and the proportion of non fibrous particles with diameters greater than about 150 microns included in said mineral fiber material is less than or equal to about 2% by weight.

7. The composite material according to claim 1, wherein, in said hybrid fiber mixture material, said amorphous alumina-silica fiber material and said mineral fiber material are mutually substantially evenly mixed together.

8. The composite material according to claim 1, wherein said matrix metal is aluminum alloy.

9. A composite material according to claim 1, wherein said matrix metal is magnesium alloy.

10. A composite material according to claim 1, wherein said matrix metal is zinc alloy.

11. A composite material according to claim 1, wherein said matrix metal is lead.

12. A composite material according to claim 1, wherein said matrix metal is tin alloy.

13. The composite material according to claim 1, wherein said other substances added to said amorphous alumina-silica fiber material or said mineral fiber material is selected from the group of metal oxides of CaO, MgO, $Na_2O$, $Fe_2O_3$, $Cr_2O_3$, $ZrO_2$, $TiO_2$, PbO, $SnO_2$, ZnO, $MoO_3$, NiO, $K_2O$, $MnO_2$, $B_2O_3$, $V_2O_5$, CuO and $Co_3O_4$.

14. The composite material according to claim 1, wherein said amorphous alumina-silica fibers are short fibers having an average fiber diameter of approximately 1.5 to 5.0 microns and a fiber length of 20 microns to 3 millimeters.

15. The composite material according to claim 1, wherein said amorphous alumina-silica fibers are long fibers having an average fiber diameter of approximately 3 to 30 microns.

16. The composite material according to claim 1, wherein said mineral fibers are short fibers with a fiber diameter of about 1 to 10 microns and with a fiber length of about 10 microns to about 10 cm.

* * * * *